US006105340A

United States Patent [19]

Draghetti

[11] Patent Number: 6,105,340

[45] Date of Patent: Aug. 22, 2000

[54] METHOD OF FASHIONING PACKETS OF CIGARETTES AND EQUIPMENT FOR THE IMPLEMENTATION OF SUCH A METHOD

[75] Inventor: Fiorenzo Draghetti, Medicina, Italy

[73] Assignee: G.D S.p.A., Bologna, Italy

[21] Appl. No.: 09/294,909

[22] Filed: Apr. 20, 1999

[30] Foreign Application Priority Data

Apr. 22, 1998 [IT] Italy ..... BO98A0255

[51] Int. Cl.[7] ..... B65B 61/20

[52] U.S. Cl. ..... 53/415; 53/136.1; 53/157; 53/170; 53/445; 53/449

[58] Field of Search ..... 53/136.1, 136.3, 53/157, 170, 415, 445, 449

[56] References Cited

U.S. PATENT DOCUMENTS

| | | |
|---|---|---|
| 4,086,744 | 5/1978 | Seragnoli . |
| 4,181,561 | 1/1980 | Seragnoli . |
| 4,198,258 | 4/1980 | Glosmann . |
| 4,620,891 | 11/1986 | Applegate et al. . |
| 4,655,871 | 4/1987 | Mattei et al. . |
| 4,840,007 | 6/1989 | Focke et al. . |
| 5,009,741 | 4/1991 | Focke et al. . |
| 5,111,633 | 5/1992 | Draghetti . |
| 5,121,585 | 6/1992 | Focke et al. . |
| 5,133,827 | 7/1992 | Ratermann . |
| 5,203,953 | 4/1993 | Focke et al. . |
| 5,309,695 | 5/1994 | Frabetti et al. . |
| 5,314,559 | 5/1994 | Rinehart et al. . |
| 5,497,598 | 3/1996 | Boldrini . |
| 5,573,628 | 11/1996 | Boldrini . |
| 5,607,526 | 3/1997 | Buckley . |

FOREIGN PATENT DOCUMENTS

| | | |
|---|---|---|
| 0 597 470 | 5/1994 | European Pat. Off. . |
| 0 679 578 | 11/1995 | European Pat. Off. . |
| 2 157 260 | 10/1985 | United Kingdom . |

*Primary Examiner*—Daniel B. Moon
*Attorney, Agent, or Firm*—Pillsbury Madison & Sutro LLP

[57] ABSTRACT

Unsealed packets of cigarettes emerging from a packaging machine present an outer surface that consists of an opaque wrapping material, to which a revenue stamp and a coupon are affixed as the packets are transferred directly and in an ordered succession from the packaging machine to a cellophaner; on reaching the cellophaner, each packet in turn is enveloped in a sheet of transparent overwrapping material covering the opaque wrapping material, the revenue stamp and the coupon, and the overwrapping sealed in such a way that the finished packet will remain substantially airtight

14 Claims, 3 Drawing Sheets

D1
P1

METHOD OF FASHIONING PACKETS OF CIGARETTES AND EQUIPMENT FOR THE IMPLEMENTATION OF SUCH A METHOD

BACKGROUND OF THE INVENTION

The present invention relates to a method of fashioning packets of cigarettes.

In particular, the present invention relates to a method by which to fashion sealed packets of cigarettes.

A typical packet of cigarettes is composed of an ordered group of cigarettes, a first sheet of soft and generally metal foil backed wrapping material enveloping the cigarettes, and a second sheet of soft wrapping material enveloping the first sheet; in this instance the packet produced is of the soft or crush type. Alternatively, the second sheet of wrapping material can be a stiff material such as cardboard, procured in the form of a diecut blank which is folded about the first wrapper to fashion a packet of the rigid type incorporating a hinged lid. The single packet of cigarettes, be it a crush or rigid type, is overwrapped in a relative sheet of transparent material, normally cellophane® or polypropylene, of which the folds are sealed to obtain a substantially airtight closure.

Packets of cigarettes are manufactured utilizing equipment that includes packaging machines, with stations by which the wrapping materials mentioned above are applied to and folded around the relative groups of cigarettes, and cellophaners comprising a feed station supplying single cellophane sheets, folding stations at which the sheets are wrapped around the packets, and sealing stations by which the folded cellophane sheets are secured.

In addition to these steps, it is customary in certain countries to affix a revenue stamp to each single packet of cigarettes before the cellophane overwrapping is applied. The stamp indicates that the packet is subject to a state excise duty in the country of sale, and remains visible through the transparent overwrapping.

Likewise in certain countries, it is the practice to insert a printed coupon into each packet. The coupon appears as a single leaf or fan-folded slip of paper, which might bear an advertising message or a collectable image, and is inserted normally between the first sheet of wrapping material and the second sheet or the cardboard blank, depending on the type of packet). It has been found that the product suffers damage when the coupon is placed in direct contact with the first sheet of wrapping material, since the inks on the printed face of the coupon give off vapors that affect the aroma of the tobacco.

Furthermore, the equipment employed typically to fashion packets with both the revenue stamp and a coupon is somewhat complex, as provision must be made for a coupon dispensing station in amongst the folding stations by which the sheets of wrapping material are flattened and secured.

Conventional packaging machinery is complicated by the inclusion of devices serving to dispense and insert the coupon, with the result that the single steps of the wrapping process are slowed down and the productivity of the system overall is reduced.

The object of the present invention is to provide a method for fashioning packets of cigarettes with respective revenue stamps and coupons and a sealed overwrapping, such as will be unaffected by the drawbacks associated with the prior art.

In particular, the object of the invention is to provide a method for fashioning sealed packets of cigarettes with corresponding revenue stamps and coupons such as can be implemented using notably simple equipment capable of high productivity.

SUMMARY OF THE INVENTION

The stated object is realized in a method as disclosed herein for fashioning sealed packets of cigarettes furnished with respective revenue stamps and respective coupons, which comprises the steps of assembling packets of cigarettes in a packaging machine, each presenting an outer surface afforded by an opaque wrapping material; transferring the packets of cigarettes directly from the packaging machine to a cellophaner; overwrapping the opaque wrapping material of each packet with a transparent material and securing the transparent material to fashion a sealed packet of cigarettes; applying a revenue stamp to the outer surface of each packet during the transfer step, and applying a coupon to the outer surface of each packet during the transfer step.

The present invention also relates to equipment for fashioning sealed packets of cigarettes.

Equipment according to the present invention for fashioning sealed packets of cigarettes, each with a respective revenue stamp and a respective coupon, comprises a packaging machine serving to assemble unsealed packets of cigarettes presenting an opaque wrapping material outermost; a cellophaner by which a transparent overwrapping material is applied over the opaque wrapping material of each packet in turn to form a respective sealed packet of cigarettes; a device by which unsealed packets of cigarettes are transferred directly from the packaging machine to the cellophaner; also a device by which a revenue stamp is applied to each packet of cigarettes and a device by which a coupon is applied to each packet of cigarettes.

To advantage, the device for applying the revenue stamps and the device for applying the coupons are positioned along the transfer device.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
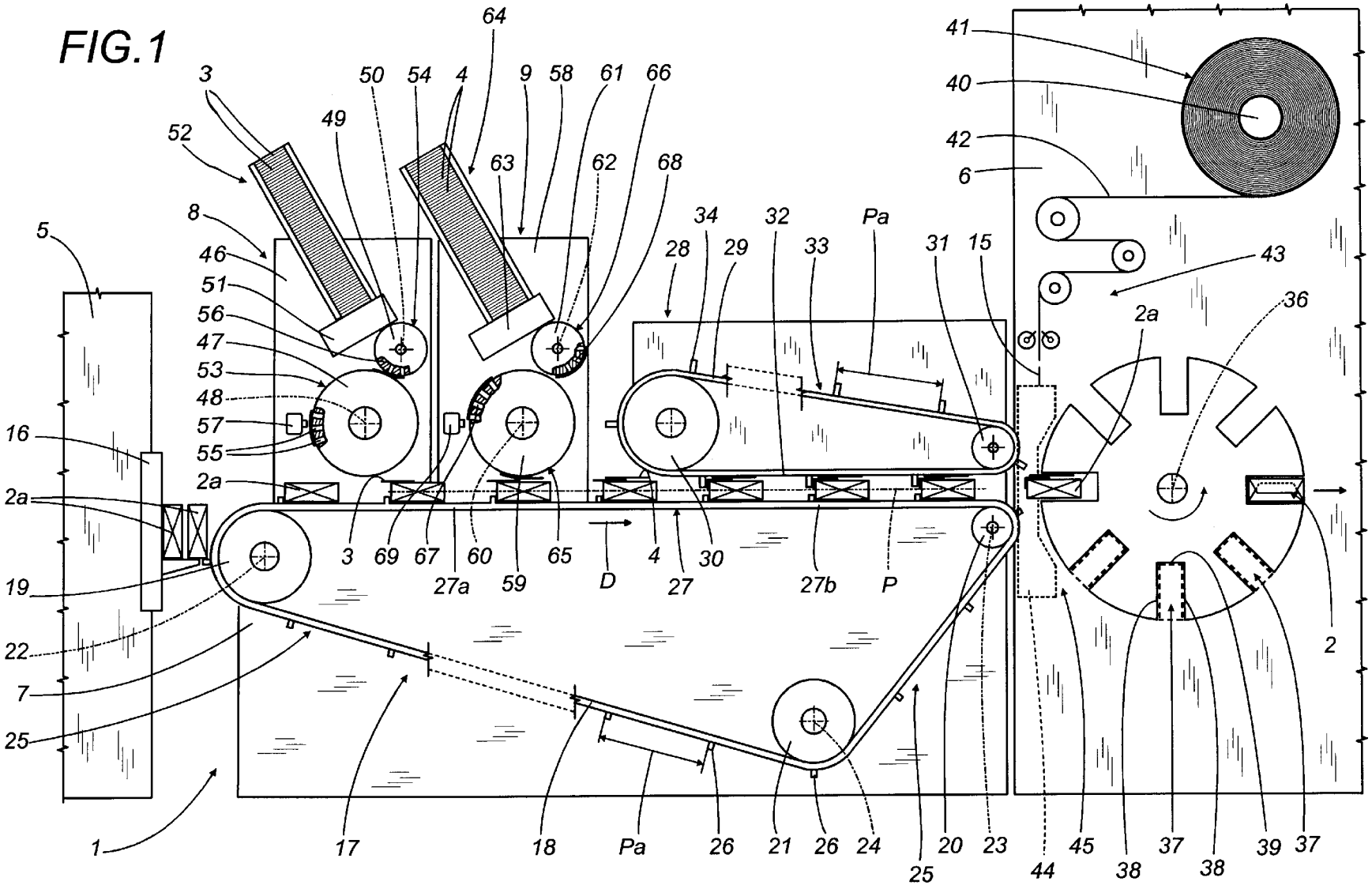
FIG. 1 illustrates equipment for implementation of the method according to the present invention, in a first solution, viewed in a side elevation and with parts omitted for clarity.

In FIG. 1 of the drawings, 1 denotes equipment by means of which to fashion sealed packets 2 of cigarettes, each with a respective revenue stamp 3 and a respective coupon 4 or advertising leaflet. The equipment 1 comprises a packaging machine 5, a cellophaner 6 connected to the packaging machine 5 by way of a transfer device 7, and located along the transfer device, a device 8 for dispensing and affixing the revenue stamps 3 and a device 9 for dispensing and affixing the coupons 4.

Figure 2:
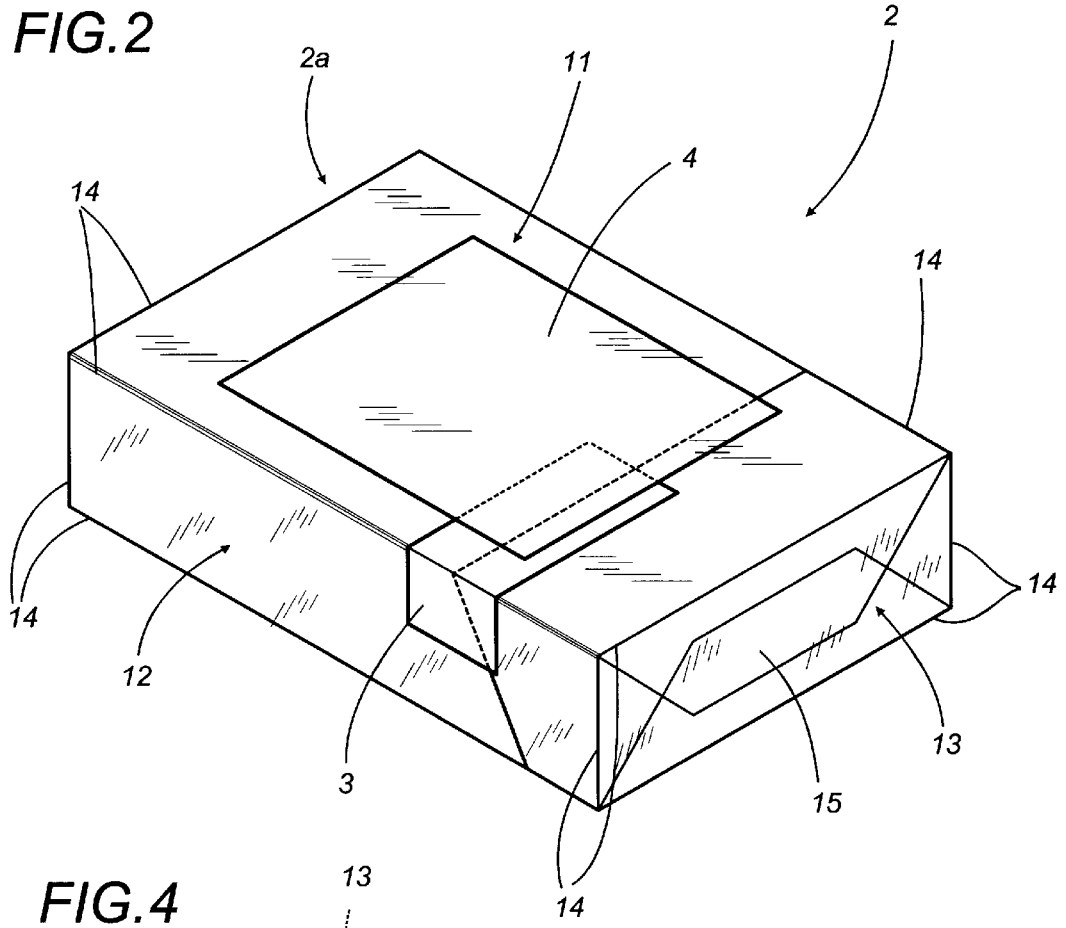
FIG. 2 illustrates a packet of cigarettes fashioned using the equipment of FIG. 1, seen in perspective.

As discernible to advantage in FIG. 2, the sealed packet 2 of cigarettes comprises a packet 2*a* of which the outer surface 10, in the unsealed state, consists of an opaque wrapping material; the packet is parallelepiped in shape, exhibiting two larger faces 11, two flank faces 12, two end faces 13 and twelve edges 14 along which the adjoining faces 11, 12 and 13 are interconnected. The packet 2 carries a revenue stamp 3, rectangular in shape, of which one portion is applied to a larger face 11 and the remaining portion to an adjoining flank face 12; in effect, the stamp 3 is bent to a right angle and straddles the edge 14 by which the two faces 11 and 12 are interconnected. The coupon 4 is essentially rectangular, with dimensions smaller than those of the larger face 11, and applied to the same face as that occupied by the stamp 3 in such a way that the stamp 3 is covered in part. Finally, the packet 2 of cigarettes comprises a sheet 15 of transparent cellophane enveloping the packet 2*a* and clinging to the outer surface 10, to the revenue stamp 3 and to the coupon 4.

The packaging machine 5 comprises an outfeed device 16 by which the packets 2*a* are directed from this same machine 5 to the transfer device 7.

The transfer device 7 comprises a belt conveyor 17 that extends from the packaging machine 5 to the cellophaner 6 and consists in a belt 18 looped over pulleys 19, 20 and 21 rotatable about respective axes 22, 23 and 24 disposed normal to the viewing plane of FIG. 1. The belt 18 affords a succession of pockets 25 distributed evenly at a given pitch Pa along its developable length, delimited by slats 26 disposed transversely to the longitudinal axis of the developable face. The looped belt 18 comprises an active branch 27 extending along a substantially horizontal feed direction D, which is composed of a portion 27*a* lying nearer to the packaging machine 5 and a portion 27*b* nearer to the cellophaner 6. The transfer device 7 also comprises a belt conveyor 28 located above the conveyor denoted 17, consisting in a belt 29 looped over two pulleys 30 and 31 and presenting an active branch 32 parallel with and facing the aforementioned portion denoted 27*b*. This belt 29 likewise affords a succession of pockets 33 distributed evenly along its developable length, at the same pitch Pa as the pockets denoted 25, which are delimited by slats 34 disposed transversely to the longitudinal axis of the developable face.

The cellophaner 6 comprises a wrapping wheel 35 rotatable about an axis parallel to the axes 22, 23 and 24 of the pulleys, which exhibits a plurality of pockets 37 each affording two mutually opposed side walls 38 and a back wall 39 and proportioned to accommodate a single packet 2*a* of cigarettes. In addition, the cellophaner 6 comprises a support 40 carrying a roll 41 of cellophane strip 42, and a device 43 by which the strip 42 is decoiled and divided into single sheets 15, also a device 44 by which the cut sheets 15 of cellophane are conveyed toward a folding station 45 disposed between the belt conveyor 17 and the wrapping wheel 35, and by which the packets 2*a* are directed from the transfer device 7 into the pockets 37 of the wheel in such a manner that each will intercept a relative sheet 15 before entering the respective pocket 37.

The devices 8 and 9 for dispensing and affixing the revenue stamps 3 and coupons 4 are disposed in succession, relative to the feed direction D, along and above the initial portion 27*a* of the active branch 27. The first device 8 comprises a frame 46, supporting an applicator drum 47 rotatable about an axis 48 perpendicular to the viewing plane of FIG. 1 and lying above the initial portion 27*a* of the active branch 27, and a take-up drum 49 rotatable substantially tangential to the applicator drum 47 about an axis denoted 50, located adjacent to a device 51 by which the stamps 3 are extracted from a magazine 52. More exactly, the drums 47 and 49 present respective cylindrical surfaces 53 and 54 affording respective uniformly distributed suction holes 55 and 56 by which the stamps 3 are retained during their transfer from the magazine 52 to the packet. The frame 46 also carries a gumming device 57 positioned at a point alongside the cylindrical surface 53 of the applicator drum 47, by which an adhesive substance is applied to each successive stamp 3.

In like manner, the coupons 4 are dispensed and affixed by a device 9 that comprises a frame 58, supporting an applicator drum 59 rotatable about an axis 60 perpendicular to the viewing plane of FIG. 1 and positioned above the initial portion 27*a* of the active branch 27, and a take-up drum 61 rotatable substantially tangential to the applicator drum 59 about an axis denoted 62, located adjacent to a device 63 by which the coupons 4 are extracted from a magazine 64. These drums 59 and 61 also present respective cylindrical surfaces 65 and 66 affording respective uniformly distributed suction holes 67 and 68 by which the coupons 4 are retained during their transfer from the magazine to the packet. The frame 58 carries a gumming device 69 positioned at a given point alongside the cylindrical surface 65 of the applicator drum 59, by which an adhesive substance is applied to each successive coupon 4.

In operation the unsealed packets 2*a* are released in succession from the outfeed device 16 of the packaging machine 5 onto the active branch 27 of the belt conveyor 17 and taken up by the respective pockets 25 disposed with one face 11 flat against the surface of the belt 18 and the two end faces 13 parallel to the feed direction D. Each individual packet 2*a* occupies a corresponding pocket 25 and advances continuously in the feed direction D along a predetermined path P toward the cellophaner 6, carried by the belt 18 and by a respective slat 26.

As the packets advance, the first dispensing and affixing device 8 directs the revenue stamps 3 in ordered succession toward the packets 2*a* occupying the respective portion 27*a* of the active branch 27. The extractor device 51 takes the stamps 3 one at a time from a stack loaded into the magazine 52 and offers them to the cylindrical surface 54 of the take-up drum 49, on which they are retained each in turn by a corresponding suction hole 56. Thus, the stamps 3 are transferred in an ordered succession from the magazine 52 to the suction holes 56 of the take-up drum 49, thence to the suction holes 55 of the applicator drum 47. The stamps 3 are rotated by this same drum 47 in an counterclockwise direction, as viewed in FIG. 1, and transferred ultimately to the respective packets 2*a* of cigarettes. During the course of the transfer, the stamps 3 are conveyed past the gumming device 57, which will deposit the adhesive substance on each one.

The suction holes 55 of the applicator drum 47 are spaced at the same pitch Pa as the pockets 25 of the conveyor 17 and timed also with the pockets in such a way that a portion of the stamp 3 will be affixed to the upwardly directed larger face 11 of each packet 2*a*. Once the stamp 3 has been attached, the relative packet 2*a* advances toward the coupon dispensing device 4 with the unaffixed portion of the stamp 3 projecting freely.

In like manner the second dispensing and affixing device 9 proceeds to direct the coupons 4 in an ordered succession toward the packets 2*a* lying on the initial portion 27*a* of the active branch 27. The extractor device 63 takes the coupons 3 one at a time from a stack loaded into the magazine 64 and offers them to the cylindrical surface 66 of the take-up drum 61, on which they are retained each in turn by a corresponding suction hole 68. Thus, the coupons 4 are transferred in an ordered succession from the magazine 64 to the suction holes 68 of the take-up drum 61, thence to the suction holes 67 of the applicator drum 59. The coupons 4 are rotated by the drum 59 in an counterclockwise direction, as viewed in FIG. 1, and transferred ultimately to the respective packets 2*a* of cigarettes. During the course of the transfer, the coupons 4 are conveyed past the gumming device 69, which will deposit the adhesive substance on each one.

The suction holes 67 of the applicator drum 59 are spaced at the same pitch Pa as the pockets 25 of the conveyor 17 and timed with the pockets in such a way as to affix the coupon 4 to the upwardly directed larger face 11 of each packet 2*b*, covering the stamp 3 in part. After each coupon 4 has been affixed, the relative packet 2*a* advances toward the cellophaner 6 together with the coupon 4 and the partially affixed stamp 3.

The packets 2*a* are now advanced along the portion of the active branch 27 denoted 27*b*, the downwardly directed larger face 11 in contact with the one belt 18 and the upwardly directed larger face 11 in contact with the belt 29 above. In other words, a packet 2*a* advancing along this same portion 27*b* of the active branch 27 occupies both the pocket 25 of the bottom conveyor 17 and the pocket 33 of the top conveyor 28, and is pushed in the feed direction D by the slats 26 and 34 of both belts. The slats 34 of the top belt are set at the same pitch Pa as the slats 26 of the bottom belt, and their movement is timed with that of the bottom slats in such a way that each top slat 34 will align vertically with a bottom slat 26 and flatten the projecting portion of the revenue stamp 3 against the flank face 12 of the packet 2*a*, maintaining it in this position as the packet 2*a* advances toward the cellophaner 6.

A sheet 15 of overwrapping material is advanced by the cellophaner 6 toward the folding station 45, that is to say between the runout end of the active branch 27 and the wrapping wheel 35, and held there in a position transverse to the feed direction D. The wheel 35 pauses intermittently, offering each pocket 37 in turn to the station 45 with the two side walls 38 aligned respectively on the active branch 27 of the bottom belt 18 and on the active branch 32 of the top belt 29. During the pause, a packet 2*a* now complete with the revenue stamp 3 and the coupon 4 will be directed into the pocket 37 waiting at the folding station 45. As the packet 2*a* passes from the transfer device to the cellophaner, the sheet 15 is intercepted and forced initially to bend around the packet 2*a*, assuming a "U" profile. The wheel 35 then rotates, carrying the packet 2*a* together with the revenue stamp 3, the coupon 4 and now the overwrapping sheet 15, which is folded and sealed by the cellophaner 6 in conventional manner (not illustrated) to fashion a sealed packet 2 of cigarettes as in FIG. 2.

Figure 3:
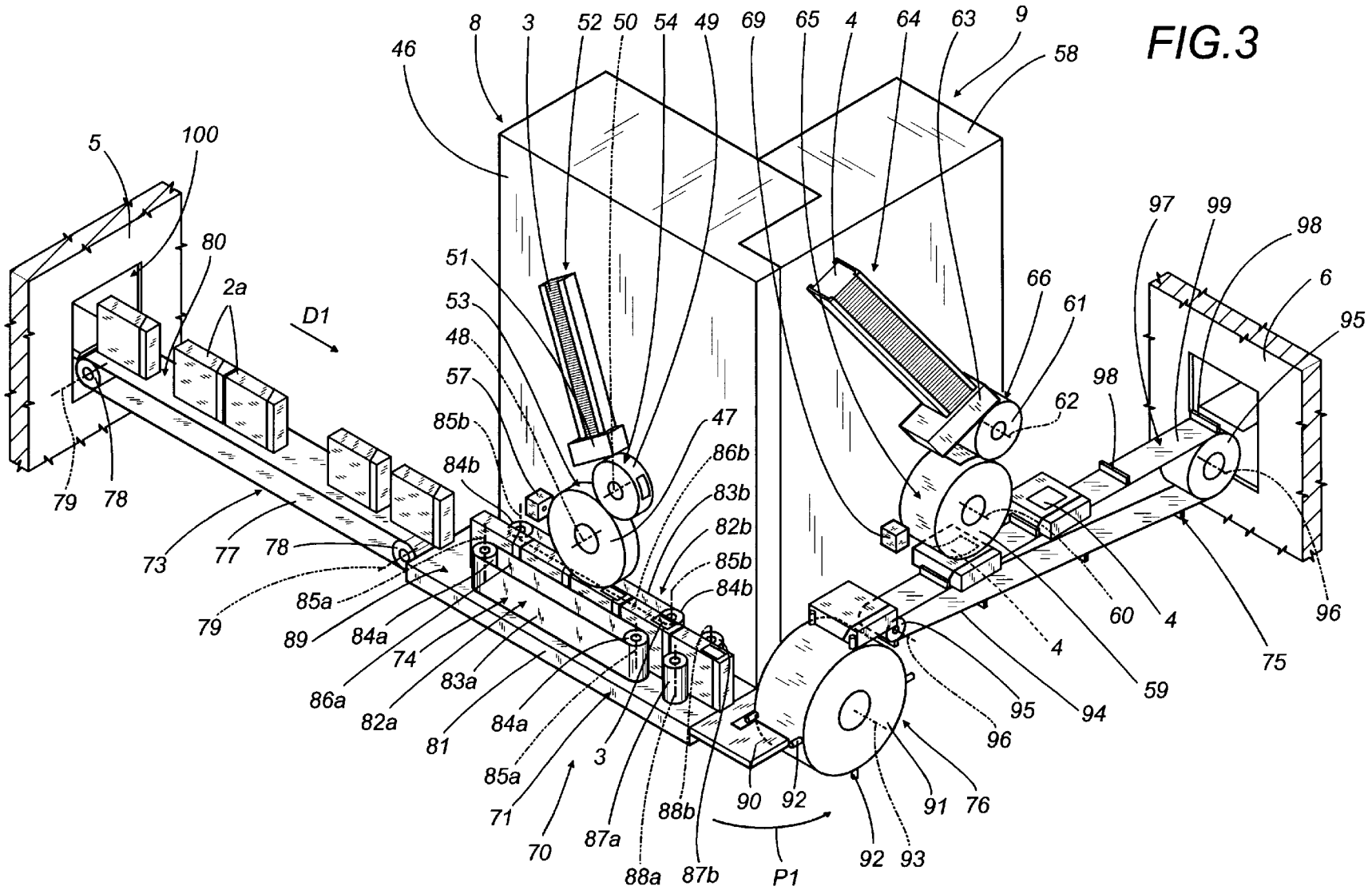
FIG. 3 illustrates equipment for implementation of the method according to the present invention, in a second solution, viewed in perspective and with parts omitted for clarity.

The equipment 70 in the example of FIG. 3 includes a packaging machine 5 and a cellophaner 6 disposed at right angles one to the other, a dispensing and affixing device 8 for the revenue stamps 3 and a dispensing and affixing device 9 for the coupons 4 also disposed at right angles one to another, and a transfer device 71 by which the unsealed packets 2*a* are conveyed from the packaging machine 5 to the cellophaner 6 along a path denoted P1.

Figure 4:
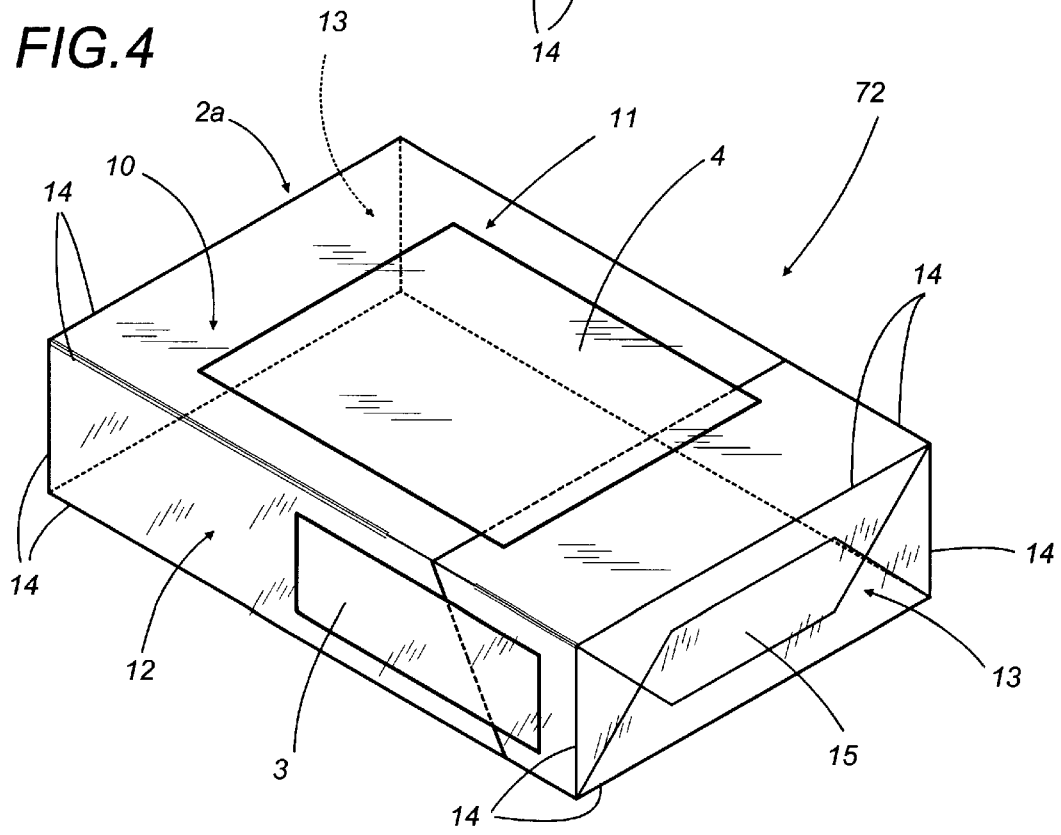
FIG. 4 illustrates a packet of cigarettes fashioned using the equipment of FIG. 1, seen in perspective.

This device 71 is employed in fashioning a sealed packet 72 of cigarettes which, as illustrated to advantage in FIG. 4, comprises a packet 2*a* with a revenue stamp 3 affixed along one flank face 12 and a coupon 4 affixed to one larger face 11, which is overwrapped in a sheet 15 of cellophane.

The transfer device 71 comprises a first belt conveyor 73 positioned downline of the packaging machine 5, a second conveyor 74 positioned downlime of and in longitudinal alignment with the first, a further conveyor 75 positioned directly upline of the cellophaner 6 and transversely to the second conveyor 74, and a flipper wheel 76 located between the latter two conveyors 74 and 75.

The first conveyor 73 comprises a belt 77 looped over two pulleys 78 rotatable about respective substantially horizontal axes 79, and affords an active branch 80 along which the packets 2*a* of cigarettes are caused to advance in a predetermined feed direction D1.

The second conveyor 74, which follows this same feed direction D1, comprises a platform 81 and, extending along a portion of the platform, a pair of belt conveyors 82*a* and 82*b* disposed facing and parallel with one another. Each such conveyor 82*a* and 82*b* comprises a respective belt 83*a* and 83*b* looped over a relative pair of pulleys 84*a* and 84*b* rotatable respectively about substantially vertical axes 85*a* and 85*b* orthogonal to the axes 79 of the pulleys 78 mentioned above. The conveyors 82*a* and 82*b* further comprise respective active branches 86*a* and 86*b* set parallel and mutually opposed, between which the single packet 2*a* is gripped by its two opposite larger faces 11. Also forming part of the conveyor 74 are two rollers 87*a* and 87*b* occupying a portion of the platform 81 beyond the two belt conveyors 82*a* and 82*b*, disposed facing and parallel with one another and rotatable about respective vertical axes 88*a* and 88*b*. The platform 81 affords a surface 89 along which the packets 2*a* are caused to advance by the belt conveyors 82*a* and 82*b* and the rollers 87*a* and 87*b* toward a shelf denoted 90. The shelf 90 is aligned with the platform 81 and disposed adjacent to the flipper wheel 76, which appears as a drum 91 equipped with pairs of arms 92 distributed uniformly about the cylindrical surface of revolution and rotatable about a horizontal axis denoted 93. The two arms 92 of each pair are set at a given distance one from another, the width of the shelf 90 being compassed freely between the arms 92 of each pair.

The conveyor denoted 75 runs between the flipper wheel 76 and the cellophaner 6 and consists in a belt 94, looped over two pulleys 95 rotatable about substantially horizontal respective axes 96. The belt 94 is embodied with a succession of pockets 97 distributed uniformly along its developable surface and delimited by respective slats 98, and affords a substantially horizontal active branch 99.

100 denotes the outfeed device of the packaging machine 5, from which the packets 2*a* are directed onto the first conveyor 73 with one flank face 12 resting on the active branch 80.

The revenue stamps 3 are dispensed by a relative device 8 positioned above the second conveyor 74 and directly over the belt conveyors 82*a* and 82*b*, in such a way as to affix a stamp 3 to a relative packet 2*a* advancing between the belts 83*a* and 83*b*, whilst the coupons 4 are dispensed by a device 9 disposed above the transverse conveyor 75 in such that a coupon 4 can be affixed to each packet 2*a* advancing along the active branch 97.

In operation, unsealed packets 2*a* are directed by the outfeed device 100 of the packaging machine 5 onto the active branch 80 of the first conveyor 73 and advanced along the feed direction D1 toward the second conveyor 74, proceeding at a predetermined first velocity V1. The packets 2*a* are taken up in succession between the mutually opposed vertical conveyors 82*a* and 82*b*, their larger faces 11 in contact with the active branches 86*a* and 86*b* of the two belt loops, and advanced along the platform 81 at a velocity V2 lower than the first velocity V1. In this way, the packets 2*a* are decelerated and ordered along the conveyors 82*a* and 82*b* with their corresponding end faces 13 breasted in contact one with another.

More exactly, the packets 2*a* advance between the two mutually opposed conveyors 82*a* and 82*b* disposed with one flank face 12 offered to the surface 89 of the platform 81, the larger faces 11 offered to the belts 83*a* and 83*b*, and the remaining flank face 12 offered upwards in readiness to receive a stamp 3. The revenue stamp 3 is dispensed and affixed in the same manner as described already for the embodiment of FIG. 1.

As the stamps 3 are affixed, the packets 2*a* are accelerated by the rollers 87*a* and 87*b*, distanced one from the next as a result, and advanced singly and in succession onto the shelf 90 where each one pauses in turn. The rotation of the wheel 76 brings each pair of arms 92 into contact with a packet 2*a* occupying the shelf 90, whereupon the packet 2*a* is taken up and transferred to a pocket 97 of the next conveyor 75 by the action of the arms 92, which are located on either side of the relative belt 94 in order to avoid contact between the wheel 76 and the conveyor 75. The packets 2*a* are flipped during the resulting transfer movement in such a way that each is released into a pocket 97 of the conveyor 75 with one larger face 11 offered to the surface of the belt 94. As the packets 2*a* advance along the conveyor 75, a coupon 4 is applied to the upwardly directed face 11 of each one in the manner already described for the embodiment of FIG. 1.

What is claimed:

1. A method for fashioning sealed packets of cigarettes furnished with respective revenue stamps and respective coupons, comprising the steps of assembling packets of cigarettes in a packaging machine, each presenting an outer surface afforded by an opaque wrapping material; transferring the packets of cigarettes directly from the packaging machine to a cellophaner; overwrapping the opaque wrapping material of each packet with a transparent material and securing the transparent material to fashion a sealed packet of cigarettes; applying a revenue stamp to the outer surface of each packet during the transfer step, and applying a coupon to the outer surface of each packet during the transfer step.

2. A method as in claim 1, wherein the outer surface comprises two parallel and opposite larger faces, two parallel and opposite flank faces and two parallel and opposite end faces, and the coupon is applied to a first of the two larger faces.

3. A method as in claim 2, wherein the revenue stamp is applied in part to the first larger face and in part to a first flank face adjoining the first larger face, by affixing a first portion initially to the first larger face then bending and flattening the remaining portion against the first flank face.

4. A method as in claim 2, wherein the revenue stamp is applied in its entirety to a first flank face adjoining the first larger face.

5. A method as in claim 2, wherein the revenue stamp is applied at least in part to the first larger face of the packet of cigarettes.

6. A method as in claim 5, wherein the revenue stamp is covered by the coupon at least in part.

7. A method as in claim 5, wherein the revenue stamp is applied in part to the first larger face and in part to a first flank face adjoining the first larger face, by affixing a first portion initially to the first larger face then bending and flattening the remaining portion against the first flank face.

8. A method as in any one of claims 1 to 4 or 7, wherein the step of applying the revenue stamp precedes the step of applying the coupon.

9. Equipment for fashioning sealed packets of cigarettes each with a respective revenue stamp and a respective coupon, comprising a packaging machine such as will assemble unsealed packets of cigarettes presenting an opaque wrapping material outermost; a cellophaner by which a transparent overwrapping material is applied over the opaque wrapping material of each packet in turn to form a respective sealed packet of cigarettes; a device by which the unsealed packets of cigarettes are transferred directly from the packaging machine to the cellophaner; also a device by which a revenue stamp is applied to each packet of cigarettes and a device by which a coupon is applied to each packet of cigarettes, wherein the device for applying the revenue stamps and the device for applying the coupons are positioned along the transfer device.

10. Equipment as in claim 9, wherein the transfer device comprises a first rectilinear conveyor extending from the packaging machine to the cellophaner and presenting a first belt that affords a first active branch above which the device for applying the stamps and the device for applying the coupons are stationed.

11. Equipment as in claim 10, wherein the first conveyor is disposed adjacent to a wrapping wheel forming part of the cellophaner, in such a way that packets of cigarettes advancing along the conveyor can be transferred directly to the wheel.

12. Equipment as in claim 11, wherein the transfer device comprises a second conveyor located above the first conveyor and adjacent to the wrapping wheel.

13. Equipment as in claim 12, wherein the transfer device comprises a first rectilinear conveyor presenting a first belt affording a substantially horizontal active branch, and a second conveyor presenting a second belt affording a second active branch disposed parallel to the first active branch and in such a way that the packets of cigarettes are gripped between the first and second active branches.

14. Equipment as in claim 13, wherein the first conveyor comprises a plurality of first pockets distributed along the first belt at a predetermined pitch, the second conveyor comprises a plurality of second pockets distributed along the second belt, and the first and second pockets are timed in such a way as to align one with another when advancing along the respective first and second active branches.

* * * * *